US008402933B2

(12) United States Patent
Hayashi et al.

(10) Patent No.: US 8,402,933 B2
(45) Date of Patent: Mar. 26, 2013

(54) ROCKER ARM CHANGEOVER DEVICE FOR ENGINE

(75) Inventors: Yasutaka Hayashi, Wako (JP); Masataka Ikawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 340 days.

(21) Appl. No.: 12/895,869

(22) Filed: Oct. 1, 2010

(65) Prior Publication Data

US 2011/0132302 A1 Jun. 9, 2011

(30) Foreign Application Priority Data

Dec. 3, 2009 (JP) ..... 2009-275308

(51) Int. Cl.
*F01L 1/34* (2006.01)

(52) U.S. Cl. ..... 123/90.16; 123/90.39

(58) Field of Classification Search ..... 123/90.16, 123/90.39; 74/569, 559
See application file for complete search history.

(56) References Cited

U.S. PATENT DOCUMENTS

RE35,662 E * 11/1997 Murata et al. ..... 123/90.16

FOREIGN PATENT DOCUMENTS

| | | |
|---|---|---|
| JP | 11-141322 | 5/1999 |
| JP | 3396412 B2 | 5/1999 |
| JP | 2008-075479 | 4/2008 |

OTHER PUBLICATIONS

Japanese Office Action for corresponding JP Application No. 2009-275308, Nov. 2, 2011.
Chinese Office Action for corresponding CN Application No. 201010294190.4, May 22, 2012.

* cited by examiner

*Primary Examiner* — Zelalem Eshete
(74) *Attorney, Agent, or Firm* — Ditthavong Mori & Steiner, P.C.

(57) ABSTRACT

A rocker arm changeover device for an engine includes a major rocker arm to drive intake or exhaust valves. A driven rocker arm is arranged in line with the major rocker arm. A changeover pin is movable within a first pin hole and a second pin hole and to change between engagement and disengagement of the major and driven rocker arms. The first pin hole coaxially matches the second pin hole through rocking motions of the major and driven rocker arms. A first pin is movable within the first and second pin holes between a disengagement position at which the first pin is retracted into the first pin hole and an engagement position at which the first pin protrudes from the major rocker arm. A second pin is movable relative to and coaxially with the first pin within the first pin hole.

16 Claims, 5 Drawing Sheets

ROCKER ARM CHANGEOVER DEVICE FOR ENGINE

CROSS REFERENCES TO RELATED APPLICATIONS

The present application claims priority under 35 U.S.C. §119 to Japanese Patent Application No. 2009-275308, filed Dec. 3, 2009, entitled "Rocker Arm Changeover Device for Engine." The contents of this application are incorporated herein by reference in their entirety.

BACKGROUND OF THE INVENTION

1. Field of the Invention

The present invention relates to a rocker arm changeover device for an engine.

2. Description of the Related Art

A structure of related art for an internal combustion engine, such as a gasoline engine or a diesel engine (hereinafter, merely referred to as engine), changes valve-opening characteristics, such as an open/close timing, a lift amount, and a non-operation state, of at least one of an intake valve and an exhaust valve in accordance with an operating state in order to increase output and fuel consumption efficiency and to decrease noxious exhaust gas components. A mechanism that changes the valve-opening characteristics may be, for example, a structure including a high-lift cam and a low-lift cam classified depending on the lift amount of a valve; a plurality of rocker arms capable of making rocking motions by the cams; and changeover pins that change an engagement state of the rocker arms between engagement and disengagement (for example, see Japanese Patent No. 3396412).

Japanese Patent No. 3396412 includes a low-speed rocker arm serving as a major rocker arm that drives a valve, and medium-speed and high-speed rocker arms serving as driven rocker arms arranged on both sides of the low-speed rocker arm. The rocker arms can make rocking motions by cams respectively corresponding to the rocker arms. The medium-speed or high-speed rocker arm is engaged with or disengaged from the low-speed rocker arm by changeover pins. The changeover pin provided for the low-speed rocker arm arranged at the center is divided at a middle position in an axial direction with a gap interposed between the divided portions. The gap is provided to selectively allow one of the changeover pins provided in the rocker arms on both sides to protrude into the gap.

The structure disclosed in Japanese Patent No. 3396412 having the above-described changeover pin mechanism engages the low-speed rocker arm with the other rocker arms through the changeover pins that protrude from the other rocker arms and are inserted into the low-speed rocker arm. However, to prevent the pins from tilting, the changeover pins to be engaged have to have certain lengths. To allow the long changeover pins to protrude or be retracted, the rocker arms have to have large widths in the axial direction of the changeover pins. If the rocker arms with the large widths are arranged on both sides, the mechanism including the plurality of rocker arms arranged in line may become large.

Alternatively, an engagement state may be attained such that divided changeover pins provided in the low-speed rocker arm protrude and are inserted into the other rocker arms. In this case, the other rocker arms may have changeover pins that are only required to push back the divided changeover pins. Hence, the changeover pins may have small lengths. Thus, the mechanism can be small. However, with the structure disclosed in Japanese Patent No. 3396412, since the divided changeover pins have the small axial lengths, the pins may tilt while being engaged.

SUMMARY OF THE INVENTION

According to one aspect of the present invention, a rocker arm change over device for an engine includes at least one major rocker arm, at least one driven rocker arm, and a changeover pin. The at least one major rocker arm is to drive a plurality of intake valves or a plurality of exhaust valves. The at least one driven rocker arm is arranged in line with the major rocker arm. The changeover pin is movable within a first pin hole and a second pin hole and to change an engagement state of the major rocker arm and the driven rocker arm between engagement and disengagement. The first pin hole is provided in the major rocker arm and the second pin hole is provided in the driven rocker arm at positions such that the first pin hole in the major rocker arm coaxially matches the second pin hole in the driven rocker arm through rocking motions of the major rocker arm and the driven rocker arm. The changeover pin includes a first pin and a second pin. The first pin is movable within the first and second pin holes between two positions including a position of the disengagement at which the first pin is retracted into the first pin hole in the major rocker arm, and a position of the engagement at which the first pin protrudes from the major rocker arm. The second pin is movable relative to the first pin within the first pin hole in the major rocker arm coaxially with the first pin. The second pin and the first pin have mutually overlapping portions within movable ranges of the first pin and the second pin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
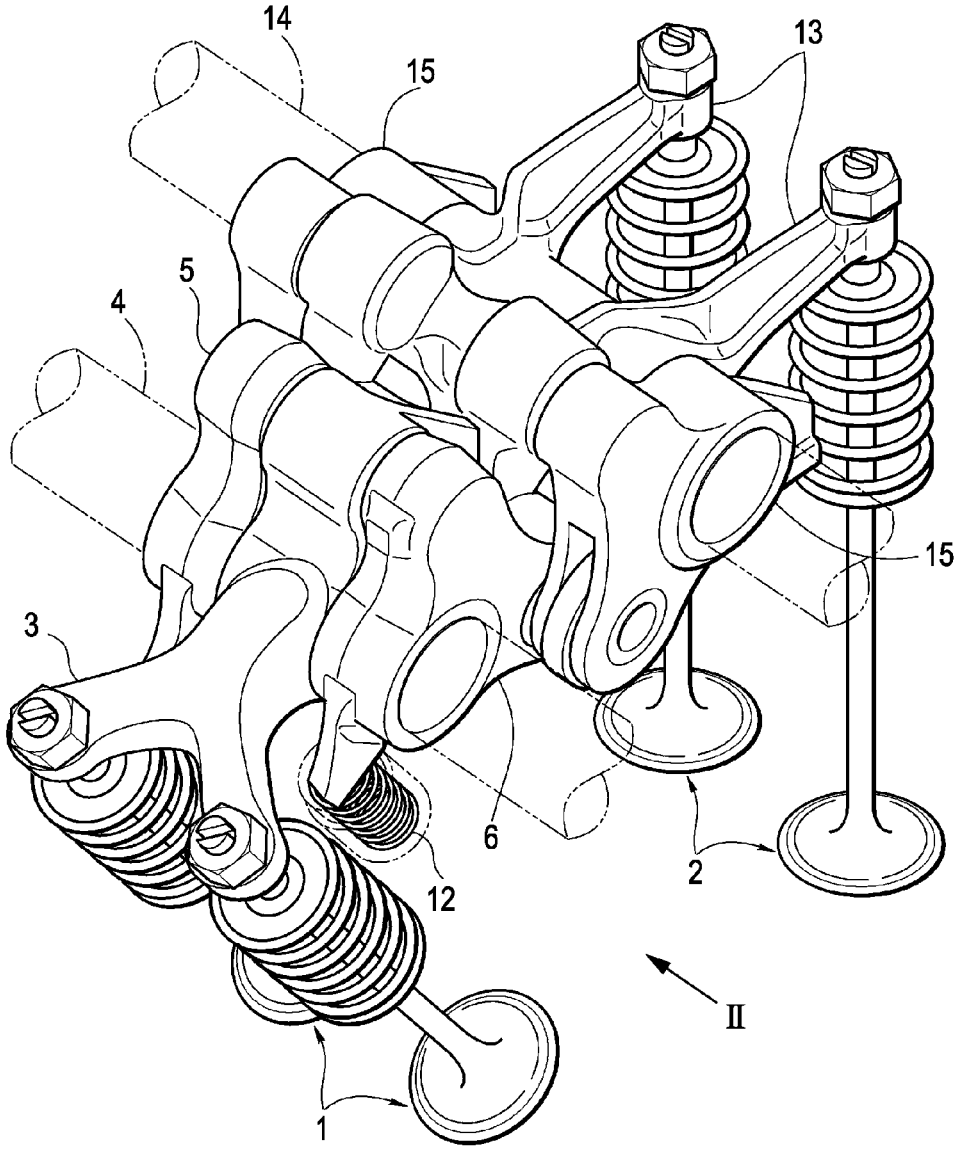
FIG. 1 is a perspective view showing a primary portion of a rocker arm mechanism for an engine to which the present invention is applied.

An embodiment of the present invention will be described below with reference to the drawings. FIG. 1 is a perspective view showing a primary portion of a rocker arm mechanism for an engine to which the present invention is applied. An illustrated exemplary engine may be a multi-cylinder engine, and includes two intake valves 1 and two exhaust valves 2 for each cylinder. The present invention may be applied to any of the intake valves 1 and the exhaust valves 2. The intake valves 1 will be described below for example.

Figure 2:
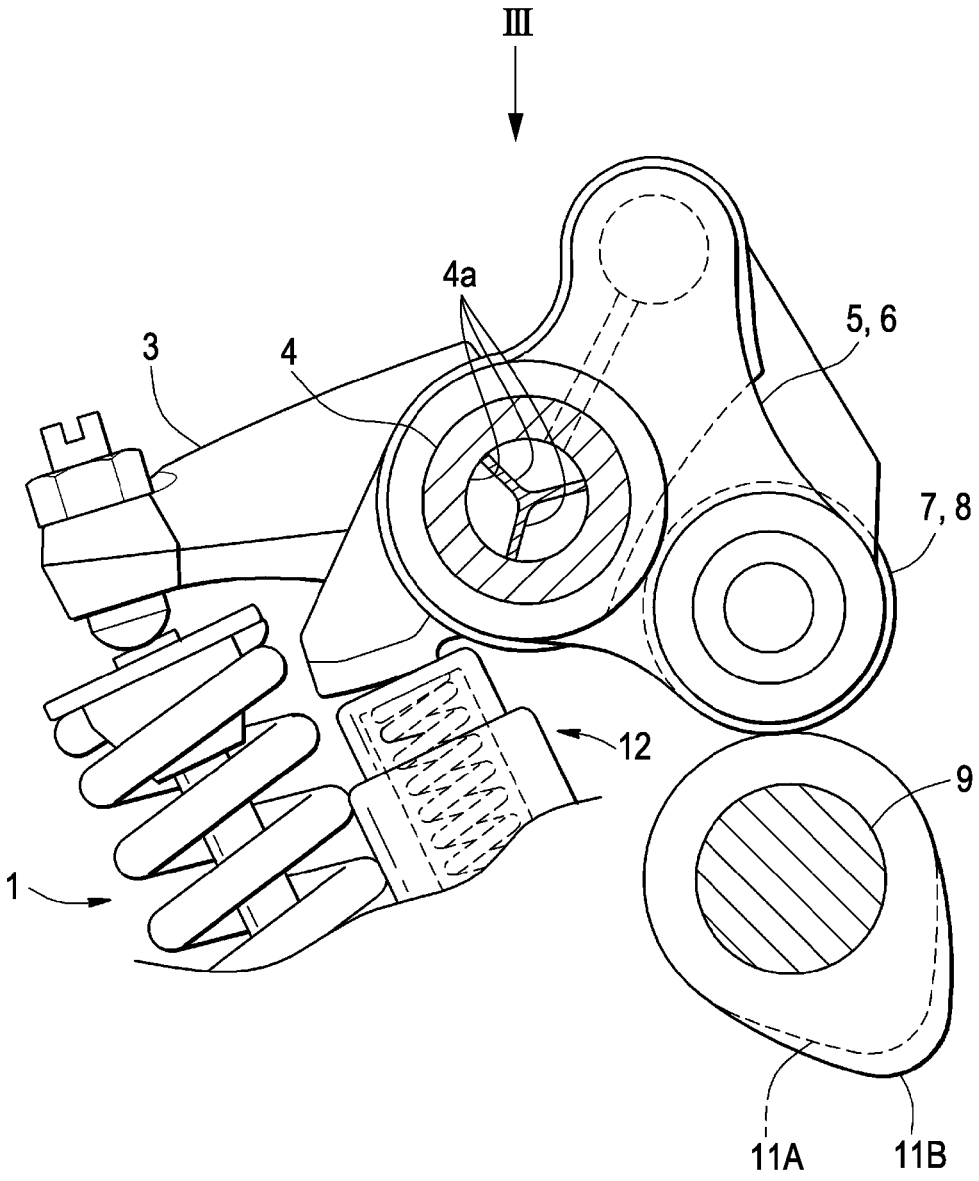
FIG. 2 is a partly sectioned side view showing the primary portion in a view of arrow II in FIG. 1.

Also referring to FIG. 2, the intake valves 1 are opened and closed through a rocking motion of a major rocker arm 3 for valve driving. A rocker shaft 4 rotatably supports a middle portion of the major rocker arm 3. Two driven rocker arms 5 and 6 are arranged in line on both sides of the major rocker arm 3 (on left and right sides in an axial direction of the rocker shaft 4 in FIG. 2). The rocker shaft 4 rotatably supports the driven rocker arms 5 and 6.

Rollers 7 and 8 are rotatably provided respectively at end portions of the driven rocker arms 5 and 6, the end portions extending from the driven rocker arms 5 and 6 outward in a radial direction with respect to the rocker shaft 4. A low-lift cam 11A and a high-lift cam 11B having cam surfaces are coaxially and integrally provided with an intake cam shaft 9 that is provided in parallel to the rocker shaft 4. The roller 7 of the one driven rocker arm 5 contacts the cam surface of the low-lift cam 11A so as to roll on the cam surface. The roller 8 of the other driven rocker arm 6 contacts the cam surface of the high-lift cam 11B so as to roll on the cam surface. The driven rocker arms 5 and 6 are urged by lost motion springs 12 in directions in which the rollers 7 and 8 respectively contact the cams 11A and 11B.

For the exhaust valves 2, a pair of rocker arms 13 and auxiliary rocker arms 15 provided on both sides of the pair of rocker arms 13 are rockably provided at a rocker shaft 14 that is parallel to the rocker shaft 4. The auxiliary rocker arms 15 are driven by low-lift and high-lift exhaust cams (not shown). The rocker arms 13 are engaged with and disengaged from the auxiliary rocker arms 15 by engagement pins (not shown), so that a drive state is changed between a low-lift drive state and a high-lift drive state.

Also referring to FIG. 3, a lift-amount changeover structure of the intake valve 1 will be described. The major rocker arm 3 and the driven rocker arms 5 and 6 provided on the left and right sides in FIG. 3 respectively have pin holes 21, 22, and 23 that may be mutually coaxially arranged. The pin hole 22 of the left driven rocker arm 5 is closed at a side far from the major rocker arm 3 and is open at a side near the major rocker arm 3. Similarly, the pin hole 23 of the right driven rocker arm 6 is closed at a side far from the major rocker arm 3 and is open at a side near the major rocker arm 3. The pin hole 21 of the major rocker arm 3 located between the other pin holes is a through hole that is open at both sides near the driven rocker arms 5 and 6. The pin hole 21 communicates with the pin holes 22 and 23 while the pin holes 21, 22, and 23 are mutually coaxially located.

Figure 3:
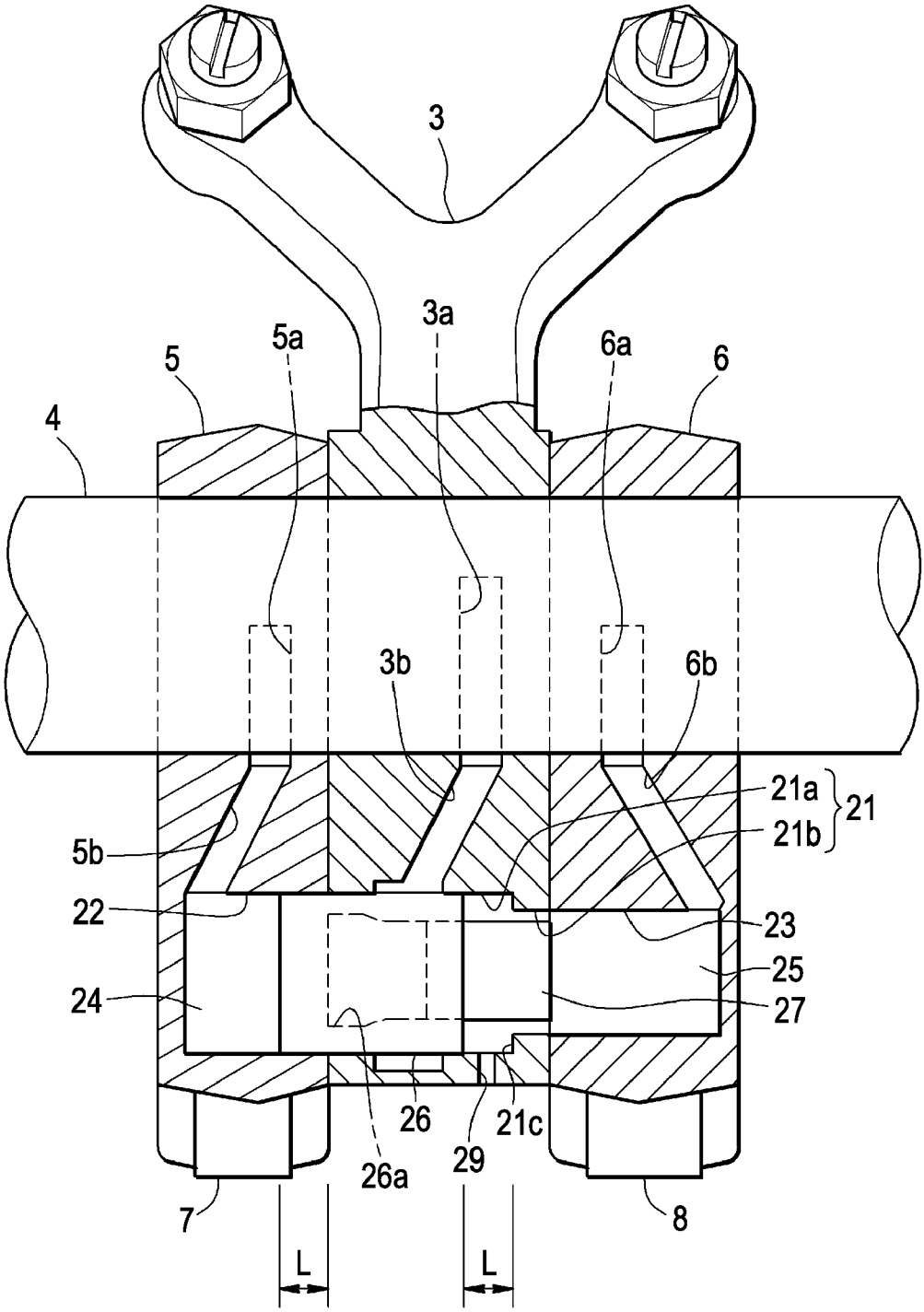
FIG. 3 is a sectioned view showing the primary portion in a view of arrow III in FIG. 2.

The pin hole 22 of the low-lift driven rocker arm 5 located on the left side in FIG. 3 has a larger diameter than the pin hole 23 of the high-lift driven rocker arm 6 located on the right side. The pin hole 21 of the major rocker arm 3 has a large-diameter hole 21*a* having a diameter equivalent to the diameter of the left pin hole 22, and a small-diameter hole 21*b* having a diameter equivalent to the diameter of the right pin hole 23. The large-diameter hole 21*a* and the small-diameter hole 21*b* are coaxially arranged. A step portion 21*c* is provided between the large-diameter hole 21*a* and the small-diameter hole 21*b* due to the difference in diameter between these holes.

A columnar large-diameter pin 24 is provided in the left pin hole 22. The large-diameter pin 24 serves as a changeover pin and can coaxially slide along the pin hole 22. The large-diameter pin 24 has an axial length that is smaller than an axial length of the pin hole 22 by a predetermined length L. Hence, the large-diameter pin 24 can move in the pin hole 22 by the length L. A columnar small-diameter pin 25 is provided in the right pin hole 23. The small-diameter pin 25 serves as a changeover pin and can coaxially slide along the pin hole 23. The small-diameter pin 25 has an axial length equivalent to an axial length of the pin hole 23. Hence, when the small-diameter pin 25 is retracted into the pin hole 23, an axial end surface of the small-diameter pin 25 exposed to the major rocker arm 3 is flush with a side surface of the high-lift driven rocker arm 6 facing the major rocker arm 6.

A main pin 26, which is a columnar first pin, and a sub-pin 27, which is a columnar second pin, are coaxially provided in the center pin hole 21. The main pin 26 and the sub-pin 27 serve as changeover pins. The main pin 26 is coaxially slidably provided in the large-diameter hole 21*a*, and has an axial length equivalent to an axial length of the large-diameter hole 21*a*. The sub-pin 27 has a diameter that allows a gap to be provided between the sub-pin 27 and an inner peripheral surface of the small-diameter hole 21*b*, so that the sub-pin 27 can be movably housed in the small-diameter hole 21*b*.

The main pin 26 has a pin support hole 26*a* having a bottom. The pin support hole 26*a* serves as a second-pin support hole that receives the sub-pin 27 coaxially slidably. The pin support hole 26*a* has an axial length (depth) substantially equivalent to an axial length of the sub-pin 27. The inner diameter of the pin support hole 26*a* and the outer diameter of the sub-pin 27 are determined such that a slight gap is provided therebetween to prevent the sub-pin 27 from tilting by a larger value than a predetermined design value.

The pins 24 to 27 are driven with hydraulic pressures. The hydraulic system will be described below. The rocker shaft 4 has three oil paths 4*a* connected with each other through a hydraulic pump and a hydraulic control valve (not shown) and extending in the axial direction. The rocker arms 3, 5, and 6 respectively have communication grooves 3*a*, 5*a*, and 6*a* (see FIG. 3). Portions of the rocker shaft 4 for rotatably supporting the rocker arms 3, 5, and 6 have branch paths (not shown) that connect the oil paths 4*a* extending in the axial direction respectively with the communication grooves 3*a*, 5*a*, and 6*a*. The communication grooves 3*a*, 5*a*, and 6*a* extend in a circumferential direction to correspond to movement ranges of the branch paths whose positions are changed when the rocker arms 3, 5, and 6 rock.

The major rocker arm 3 has a communication path 3*b* that allows the communication groove 3*a* to communicate with the large-diameter hole 21*a*. The low-lift driven rocker arm 5 has a communication path 5*b* that allows the communication groove 5*a* with a bottom portion (axial end portion) of the pin hole 22 at the side far from the major rocker arm 3. The high-lift driven rocker arm 6 has a communication path 6*b* that allows the communication groove 6*a* to communicate with a bottom portion (axial end portion) of the pin hole 23 at the side far from the major rocker arm 3. As clearly shown in FIG. 4, the main pin 26 has, for example, a pair of symmetrically arranged radial holes 26*b* that allow the communication path 3*b* to communicate with the pin support hole 26*a* in the entire movement range. The open portion of the communication path 3*b* to the large-diameter hole 21*a* is a recessed groove having a predetermined width in the axial direction and continuously extending around the whole circumference of the inner peripheral surface of the large-diameter hole 21*a* so that the radial hole 26*b* can communicate with the communication path 3*b* even if the main pin 26 axially moves in the axial direction and rotates around the axial direction.

The sub-pin 27 has a bottomed hole 27*a*. The bottomed hole 27*a* is open to a bottom surface of the pin support hole 26*a*. A compression coil spring 28 serving as a spring member is interposed between a bottom surface of the bottomed hole 27*a* at a side near the high-lift driven rocker arm 6 and the bottom surface of the pin support hole 26*a*. Hence, the sub-pin 27 is urged in a direction in which the sub-pin 27 and the main pin 26 are relatively separated from one another.

Figure 4:
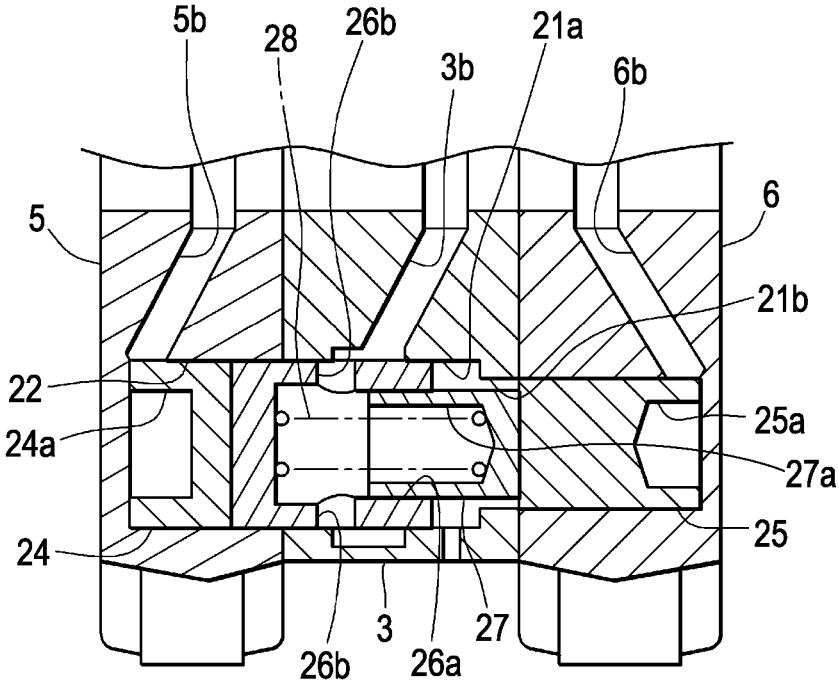
FIG. 4 is an illustration corresponding to FIG. 3 and showing a low-lift state.

The oil paths are thus arranged, and the hydraulic pressure is selectively supplied to the communication grooves 3*a*, 5*a*, and 6*a*. Thus, the rocker arms 3, 5, and 6 are engaged and disengaged. FIG. 4 illustrates a low-lift drive state (FIG. 3 also illustrates the same state). To obtain this state, the hydraulic pressure is supplied to the communication path 3*b*, and the other communication paths 5*b* and 6*b* are brought into a drain state (in which the hydraulic pressure is substantially zero). Accordingly, the hydraulic pressure is supplied into the pin support hole 26*a*, and the main pin 26 and the sub-pin 27 are separated from one another as shown in FIG. 4. The sub-pin 27 pushes the small-diameter pin 25, and the small-diameter pin 25 is retracted into the pin hole 23 of the high-lift driven rocker arm 6 as described above. The facing axial end surfaces of the small-diameter pin 25 and the sub-pin 27 contact one another in a sliding manner through rocking motions of the major rocker arm 3 and the high-lift driven rocker arm 6.

Meanwhile, part of the main pin 26 is retracted into the pin hole 22 of the low-lift driven rocker arm 5, and the large-diameter pin 24 is pushed into the deepest portion of the pin hole 22. Accordingly, the low-lift driven rocker arm 5 is engaged with the major rocker arm 3 through the main pin 26. Since the major rocker arm 3 is disengaged from the high-lift driven rocker arm 6 as described above, the major rocker arm 3 rocks by a low lift amount.

Figure 5:
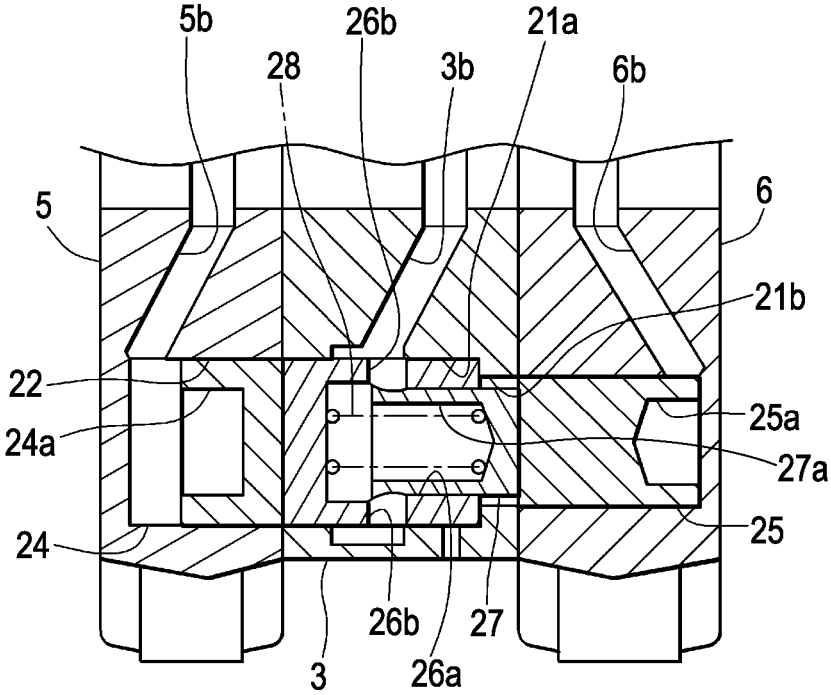
FIG. 5 is an illustration similar to FIG. 4 and showing a non-operation state.

FIG. 5 illustrates a non-operation state. To obtain this state, the hydraulic pressure is supplied to the communication path 5*b*, and the other communication paths 3*b* and 6*b* are brought into the drain state. Accordingly, the hydraulic pressure is supplied to the pin hole 22, and the large-diameter pin 24 is pushed toward the major rocker arm 3. By the movement of the large-diameter pin 24, the main pin 26 is pushed back until the main pin 26 is retracted into the large-diameter hole 21*a*. At this time, the compression coil spring 28 resists that movement. However, the resistance of the spring force is smaller than the hydraulic pressure, and hence the resistance does not affect the changeover operation.

As described above, the main pin 26 has the axial length equivalent to the axial length of the large-diameter hole 21*a*. while the main pin 26 is retracted into the large-diameter hole 21*a* and contacts the step portion 21*c*, the facing axial end surfaces of the main pin 26 and the large-diameter pin 24 contact one another in a sliding manner through the rocking motions of the major rocker arm 3 and the low-lift driven rocker arm 5. The relationship between the sub-pin 27 and the small-diameter pin 25 is similar to the aforementioned relationship. The facing axial end surfaces of the sub-pin 27 and the small-diameter pin 25 contact one another in a sliding manner through the rocking motions of the major rocker arm 3 and the high-lift driven rocker arm 6. In this state, the major rocker arm 3 is disengaged from the driven rocker arms 5 and 6. The valve lift-amount control is brought into the non-operation state.

Figure 6:
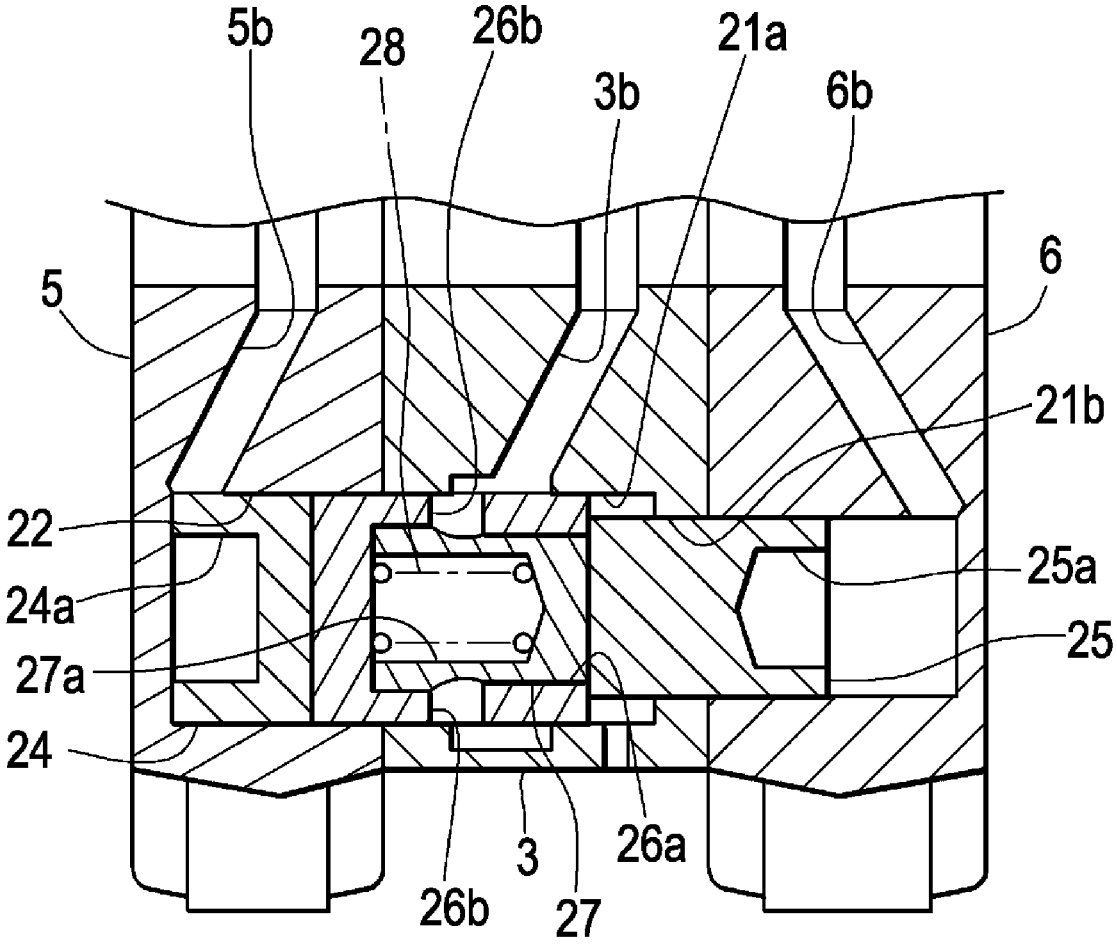
FIG. 6 is an illustration similar to FIG. 4 and showing a high-lift state.

FIG. 6 illustrates a high-lift drive state. To obtain this state, the hydraulic pressure is supplied to the communication path 6*b*, and the other communication paths 3*b* and 5*b* are brought into the drain state. Accordingly, the hydraulic pressure is supplied to the pin hole 23, and the small-diameter pin 25 is pushed toward the major rocker arm 3 and protrudes from the pin hole 23. The small-diameter pin 25 pushes the sub-pin 27, and the sub-pin 27 is retracted into the pin support hole 26*a* of the main pin 26. Since the sub-pin 27 has the smaller diameter than the small-diameter hole 21*b*, the small-diameter pin 25 having the diameter substantially equivalent to the small-diameter hole 21*b* contacts the main pin 26 while pushing the sub-pin 27 into the pin support hole 26*a*. The main pin 26 pushes the large-diameter pin 24 like in the low-lift drive state, and is stopped in a state in which the large-diameter pin 24 contacts the bottom surface of the pin hole 22. In this state, the movement of the small-diameter pin 25 is also stopped.

Accordingly, the low-lift driven rocker arm 5 is engaged with the major rocker arm 3 through the main pin 26, and the high-lift driven rocker arm 6 is engaged with the major rocker arm 3 through the small-diameter pin 25. The three rocker arms 3, 5, and 6 are engaged with one another. In this engaged state, the major rocker arm 3 rocks by a high lift amount. The low-lift driven rocker arm is also driven by the high lift amount. However, since the high-lift cam 11B has a larger cam profile than the low-lift cam 11A, the high-lift cam 11B does not interfere with the low-lift cam 11A.

As described above, the intake valve 1 can be changed into three control states of the low-lift, non-operation, and high-lift. When the changeover is carried out among the low-lift, non-operation, and high-lift, any state can be changed to any of the other two states by changing the hydraulic pressure supply to desirable one of the communication paths 3*b*, 5*b*, and 6*b*. Thus, the quick changeover can be carried out to the target state.

When the high-lift state is changed to the non-operation state or the low-lift state, since the spring force of the compression coil spring 28 acts, the pin is moved faster than the situation only relying upon the hydraulic pressure. The changeover can be smoothly carried out. Also, the large-diameter pin 24 and the small-diameter pin 25 have recessed holes 24*a* and 25*a* at sides supplied with the hydraulic pressures. Accordingly, the pins 24 and 25 have reduced weights, and the faster movement can be provided.

The recessed hole 25*a* of the small-diameter pin 25 has a depth that does not reach the boundary between the major rocker arm 3 and the high-lift driven rocker arm 6 (the boundary which is a portion where a shear force is generated by the rocking motions), as shown in FIG. 6 illustrating the engaged state through the small-diameter pin 25. Accordingly, a solid portion of the small-diameter pin 25 can receive the shear force that is generated by the high lift amount or during high-speed rotation. The solid portion can have a sufficient intensity.

Although the large-diameter pin 24 pushes the main pin 26 in the non-operation state, the outer peripheral portion of the main pin 26 contacts the step portion 21*c* defined between the large-diameter hole 21*a* and the small-diameter hole 21*b* and is positioned by the step portion 21*c*. In this state, only the spring force of the compression coil spring 28 acts on the sub-pin 27 as shown in FIG. 5. Accordingly, even though the sub-pin 27 contacts the small-diameter pin 25, the contact force only relies upon the spring force of the compression coil spring 28, and the pressure force by the hydraulic pressure is not added. Thus, a sliding frictional force between the sub-pin 27 and the high-lift driven rocker arm 6 is small. Further, since the sub-pin 27 has the smaller diameter than the small-diameter pin 25 for the engagement and the sliding area of the sub-pin 27 is small, the frictional force is small and an abnormal noise that is generated through the rotation can be reduced.

The large-diameter pin 24 at the low-lift driven rocker arm 5 contacts the major rocker arm 3 in a sliding manner as a result of the supply with the hydraulic pressure. However, since the non-operation state is selected for the low-speed rotation, the hydraulic pressure is low, and the pressure force during the contact in a sliding manner is low. Thus, an abnormal noise that is generated through the rotation can be reduced like the aforementioned case.

The sub-pin 27 contacts the high-lift driven rocker arm 6 by the hydraulic pressure in the low-lift state. Since the low-lift state is the control suitable for the low-speed rotation, the hydraulic pressure is low. Also, since the sub-pin 27 has the small diameter, an increase in sliding frictional force can be suppressed. Although the amount of oil as lubricant is small due to the low hydraulic pressure, since the main pin 26 used for the engagement between the major rocker arm 3 and the low-lift driven rocker arm 5 has the large diameter, a bearing stress of the main pin 26 to the pin hole 21 (large-diameter hole 21*a*) is decreased as compared with a case in which the small-diameter pin is used. The small amount of oil can handle the bearing stress and hence the friction can be suppressed (i.e., Hertz stress is reduced).

Also, since the telescopic structure is employed such that the sub-pin 27 is retracted into the main pin 26, the main pin 26 and the sub-pin 27 can have large axial lengths although the major rocker arm 3 has a small width or the pin hole 21 has a small axial length. Accordingly, the main pin 26 can have a sufficient flexural strength without using a special high-intensity member, in the engaged state between the major rocker arm 3 and the low-lift driven rocker arm 5 through the main pin 26 in the illustrated example. Thus, a reliable engaged state can be obtained.

For example, if a low-lift driven rocker arm is disengaged during high-lift driving (high-speed rotation), only the low-lift driven rocker arm rocks. Thus, following performance of the low-lift driven rocker arm may be a problem, and it is necessary to increase a load of a lost motion spring. In contrast, since the three rocker arms 3, 5, and 6 are engaged with one another and rock together during the high-speed rotation as described above, the aforementioned problem does not occur. Even if the spring load cannot be increased because the space is limited when the lost motion spring 12 is arranged below the rocker arm like the illustrated example, this does not cause any disadvantage. Accordingly, the height of the engine can be prevented from increasing unlike a case in which the lost motion spring 12 is arranged above the rocker arm. Thus, the engine can be compact.

Additionally, a relief hole 29 may be provided in the major rocker arm 3 at a position corresponding to the large-diameter hole 21*a*. The relief hole 29 communicates with the outside. Accordingly, the oil can be released when the size of the space, which is generated in the large-diameter hole 21*a*, the step portion 21*c*, and the small-diameter hole 21*b*, is changed because of the movement of the main pin 26 and the small-diameter pin 25 through the changeover from the low-lift state to any of the other states. Thus, the sliding resistance during the movement of the main pin 26 and the small-diameter pin 25 can be reduced.

With the embodiment of the present invention, the first pin and the second pin provided in the main rocker arm have the mutually overlapping portions and are movable. Accordingly, although the major rocker arm has a small width (length in a pin-moving direction), the pins (first and second pins) can have longer lengths as compared with a case in which the width of the main rocker arm is simply divided into two to obtain two pins. Short pins likely tilt when being engaged. In contrast, the pins according to the embodiment can be prevented from tilting.

Preferably, the second pin may have a smaller diameter than the first pin. Also, the first pin may have a second-pin support hole that receives part of the second pin to allow the second pin to protrude from and be retracted into the second-pin support hole. Accordingly, the first pin and the second pin can be moved while the second pin is constantly engaged with the second-pin support hole in a direction intersecting with the axis line. The second pin and the second-pin support hole can be prevented from tilting during the movement.

Preferably, the first pin may have an oil path through which a hydraulic pressure is supplied to the second-pin support hole, and when the hydraulic pressure is supplied to the second-pin support hole, the first pin may be moved in a direction in which the first pin is separated from the second pin. Accordingly, when the hydraulic pressure is supplied to the second-pin support hole in the first pin, the first pin and the second pin can be relatively moved (separated from one another). The first pin and the second pin can be moved by a large thrust as compared with a case in which pins are moved, for example, only by a spring force. The changeover can be reliably carried out.

Preferably, the first pin hole provided in the major rocker arm may have a large-diameter hole that movably supports the first pin, a small-diameter hole that movably houses the second pin, and a step portion between the large-diameter hole and the small-diameter hole. Also, the movement of the first pin in a direction in which the first pin may be retracted into the major rocker arm is regulated by the step portion. Accordingly, when the first pin receives a force in which the first pin is moved in the direction to be retracted into the major rocker arm, the first pin contacts the step portion of the second-pin support hole and hence the movement of the first pin is stopped. The second pin can be prevented from being further pushed by the first pin, and for example, a sliding contact pressure of the second pin to the driven rocker arm can be prevented from increasing.

Preferably, the rocker arm changeover device may further include a spring member in the second-pin support hole, the spring member urging the first pin and the second pin in a direction in which the first pin is separated from the second pin. Accordingly, the first pin and the second pin are moved in the direction to be relatively separated from one another by a spring force. The changeover pins can be moved with a simple structure. In addition, when the hydraulic pressure is also used, the movement is provided by the spring force first, and then the hydraulic pressure can be smoothly supplied between the first and second pins. Thus, an increase in hydraulic pressure can be prevented.

Preferably, the driven rocker arm may include two driven rocker arms arranged on both sides of the major rocker arm. The driven rocker arm at a side far from a side to which the first pin protrudes may include a third pin that protrudes to and is retracted from the major rocker arm to change an engagement state of the driven rocker arm and the major rocker arm between engagement and disengagement. The driven rocker arm that is brought into the engagement with the major rocker arm through the third pin from among the driven rocker arms arranged on both sides of the major rocker arm may be driven by a high-lift cam with a large valve lift amount. The driven rocker arm that is brought into the engagement with the major rocker arm through the first pin may be driven by a low-lift cam with a smaller valve lift amount than the high-lift cam. Accordingly, when the major rocker arm is driven through the engagement of the first pin, the low-lift driving is provided as compared with the high-lift. The low-lift driving provides low-speed rotation. In this case, the hydraulic pressure is low and the amount of oil around the single pin is small. However, since the first pin has the large diameter, a bearing stress to an inner peripheral surface of the pin hole is small. Thus, friction can be prevented from occurring.

Obviously, numerous modifications and variations of the present invention are possible in light of the above teachings. It is therefore to be understood that within the scope of the appended claims, the invention may be practiced otherwise than as specifically described herein.

What is claimed is:

1. A rocker arm changeover device for an engine, comprising:

at least one major rocker arm to drive a plurality of intake valves or a plurality of exhaust valves;

at least one driven rocker arm arranged in line with the major rocker arm; and a changeover pin that is movable within a first pin hole and a second pin hole to change an engagement state of the major rocker arm and the driven rocker arm between engagement and disengagement, the first pin hole being provided in the major rocker arm and the second pin hole being provided in the driven rocker arm at positions such that the first pin hole in the major rocker arm coaxially matches the second pin hole in the driven rocker arm through rocking motions of the major rocker arm and the driven rocker arm, the changeover pin comprising:

a first pin being movable within the first and second pin holes between two positions including a position of the disengagement at which the first pin is retracted into the first pin hole in the major rocker arm, and a position of the engagement at which the first pin protrudes from the major rocker arm; and a second pin being movable relative to the first pin within the first pin hole in the major rocker arm coaxially with the first pin, the second pin and the first pin having mutually overlapping portions within movable ranges of the first pin and the second pin, the second pin having a smaller diameter than the first pin, the first pin having a second-pin support hole into which part of the second pin is receivable to allow the second pin to protrude from the second-pin support hole and be retracted into the second-pin support hole, the first pin having an oil path through which a hydraulic pressure is supplied to the second-pin support hole, the first pin being moved with respect to the major rocker arm to protrude from the major rocker arm in a direction in which the first pin is separated from the second pin when the hydraulic pressure is supplied to the second-pin support hole.

2. The rocker arm changeover device for an engine according to claim 1, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

3. The rocker arm changeover device for an engine according to claim 1, wherein the first pin hole provided in the major rocker arm has a large-diameter hole that movably supports the first pin and a small-diameter hole that movably houses the second pin, the large-diameter hole and the small-diameter hole defining a step portion to regulate movement of the first pin in a direction in which the first pin is retracted into the major rocker arm.

4. The rocker arm changeover device for an engine according to claim 1, further comprising a spring member in the second-pin support hole, the spring member urging the first pin and the second pin in a direction in which the first pin is separated from the second pin.

5. The rocker arm changeover device for an engine according to claim 3, further comprising a spring member in the second-pin support hole, the spring member urging the first pin and the second pin in a direction in which the first pin is separated from the second pin.

6. The rocker arm changeover device for an engine according to claim 3, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

7. The rocker arm changeover device for an engine according to claim 3, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

8. The rocker arm changeover device for an engine according to claim 5, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

9. The rocker arm changeover device for an engine according to claim 4, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

10. The rocker arm changeover device for an engine according to claim 1, wherein the oil path of the first pin extends along a first direction perpendicular to a second direction in which the first pin is movable with respect to the major rocker arm.

11. The rocker arm changeover device for an engine according to claim 10, wherein the major rocker arm includes a communication path connected to the oil path of the first pin and extending along the first direction.

12. The rocker arm changeover device for an engine according to claim 1, wherein the major rocker arm includes a communication path connected to the oil path of the first pin and extending along a first direction perpendicular to a second direction in which the first pin is movable with respect to the major rocker arm.

13. A rocker arm changeover device for an engine, comprising:

at least one major rocker arm to drive a plurality of intake valves or a plurality of exhaust valves;

at least one driven rocker arm arranged in line with the major rocker arm;

a changeover pin that is movable within a first pin hole and a second pin hole to change an engagement state of the major rocker arm and the driven rocker arm between engagement and disengagement, the first pin hole being provided in the major rocker arm and the second pin hole being provided in the driven rocker arm at positions such that the first pin hole in the major rocker arm coaxially matches the second pin hole in the driven rocker arm through rocking motions of the major rocker arm and the driven rocker arm, the changeover pin comprising:

a first pin being movable within the first and second pin holes between two positions including a position of the disengagement at which the first pin is retracted into the first pin hole in the major rocker arm, and a position of the engagement at which the first pin protrudes from the major rocker arm; and a second pin being movable relative to the first pin within the first pin hole in the major rocker arm coaxially with the first pin, the second pin and the first pin having mutually overlapping portions within movable ranges of the first pin and the second pin, the second pin having a smaller diameter than the first pin, wherein the first pin having a second-pin support hole into which part of the second pin is receivable to allow the second pin to protrude from the second-pin support hole and be retracted into the second-pin support hole; and a spring member in the second-pin support hole, the spring member urging the first pin and the second pin in a direction in which the first pin is separated from the second pin.

14. The rocker arm changeover device for an engine according to claim 13, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

15. A rocker arm changeover device for an engine, further comprising:

at least one major rocker arm to drive a plurality of intake valves or a plurality of exhaust valves;

at least one driven rocker arm arranged in line with the major rocker arm;

a changeover pin that is movable within a first pin hole and a second pin hole to change an engagement state of the major rocker arm and the driven rocker arm between engagement and disengagement, the first pin hole being provided in the major rocker arm and the second pin hole being provided in the driven rocker arm at positions such that the first pin hole in the major rocker arm coaxially matches the second pin hole in the driven rocker arm through rocking motions of the major rocker arm and the driven rocker arm, the changeover pin comprising:

a first pin being movable within the first and second pin holes between two positions including a position of the disengagement at which the first pin is retracted into the first pin hole in the major rocker arm, and a position of the engagement at which the first pin protrudes from the major rocker arm; and a second pin being movable relative to the first pin within the first pin hole in the major rocker arm coaxially with the first pin, the second pin and the first pin having mutually overlapping portions within movable ranges of the first pin and the second pin, the second pin having a smaller diameter than the first pin, wherein the first pin having a second-pin support hole into which part of the second pin is receivable to allow the second pin to protrude from the second-pin support hole and be retracted into the second-pin support hole, the first pin hole being provided in the major rocker arm and having a large-diameter hole that movably supports the first pin and a small-diameter hole that movably houses the second pin, the large-diameter hole and the small-diameter hole defining a step portion to regulate movement of the first pin in a direction in which the first pin is retracted into the major rocker arm; and a spring member in the second-pin support hole, the spring member urging the first pin and the second pin in a direction in which the first pin is separated from the second pin.

16. The rocker arm changeover device for an engine according to claim 15, wherein the major rocker arm has a first side and a second side which is opposite to the first side and from which the first pin protrudes, wherein the driven rocker arm comprises a first driven rocker arm arranged on the first side of the major rocker arm, and a second driven rocker arm that is arranged on the second side of the major rocker arm and brought into engagement with the major rocker arm through the first pin, wherein the changeover pin further comprises a third pin in the first driven rocker arm, the third pin being to protrude into the major rocker arm and be retracted from the major rocker arm to change an engagement state of the first driven rocker arm and the major rocker arm between engagement and disengagement, wherein the first driven rocker arm that is brought into the engagement with the major rocker arm through the third pin is driven by a high-lift cam having a valve lift amount, and wherein the second driven rocker arm that is brought into the engagement with the major rocker arm through the first pin is driven by a low-lift cam having a valve lift amount smaller than the valve lift amount of the high-lift cam.

* * * * *